US005893195A

United States Patent [19]

Jung

[11] Patent Number: 5,893,195

[45] Date of Patent: Apr. 13, 1999

[54] SAFETY DEVICE FOR A BRUSH OF A VACUUM CLEANER

[75] Inventor: Young-June Jung, Seoul, Rep. of Korea

[73] Assignee: Daewoo Electronics Co., Ltd., Rep. of Korea

[21] Appl. No.: 08/927,632

[22] Filed: Sep. 11, 1997

[30] Foreign Application Priority Data

Oct. 29, 1996 [KR] Rep. of Korea ..... 96-49763

[51] Int. Cl.[6] ..... A47L 5/00

[52] U.S. Cl. ..... 15/339; 15/319; 15/375; 15/421

[58] Field of Search ..... 15/319, 339, 375, 15/421

[56] References Cited

FOREIGN PATENT DOCUMENTS 196 17 429 11/1997 Germany .

*Primary Examiner*—David A. Redding

*Attorney, Agent, or Firm*—Pillsbury Madison & Sutro, LLP

[57] ABSTRACT

Disclosed is a safety device for a power brush of a vacuum cleaner which has a simple structure and can automatically cut off an electric source supplied to the driving motor of the power brush. A cylindrical air duct is vertically provided on the brush. The air duct is attached to the body of the cleaner. A negative pressure generated by a sucking force generated by the rotation of the driving motor in the body of the cleaner acts on the air duct. An air valve moves inward by the negative pressure in the air duct. At a first end of a rod, the air valve is mounted and at a second end facing the first end, a spring for applying a rotating force to move the air valve to an external direction, is provided. The rod is movably supported by a moving shaft provided near the outer periphery of the air duct. A switch is provided at the second end side of the rod having the spring. The switch is off to cut off the electric source applied to the driving motor of the power brush to prevent the rotation of a rotating roller when the air valve moves to the external direction by the action of the spring. Accordingly, when a user does not use the vacuum cleaner, various safety accidents induced by the rotating force of the power brush can be prevented.

10 Claims, 5 Drawing Sheets

SAFETY DEVICE FOR A BRUSH OF A VACUUM CLEANER

BACKGROUND OF THE INVENTION

1. Field of the Invention

The present invention relates to a safety device for a brush of a vacuum cleaner and more particularly, to a safety device for a brush of a vacuum cleaner, which can prevent a safety accident induced by the power brush of the vacuum cleaner 2. Description of the Prior Art A vacuum cleaner is a device for absorbing external dust or other foreign substances through a strong sucking force generated by the driving of a motor provided in the body of the vacuum cleaner. The sucked dust or the foreign substances are captured by a dust collecting envelope installed in a dust collecting compartment and cleaned air is exhausted out through a driving compartment.

Generally, vacuum cleaners are classified into canister-type vacuum cleaners and upright-type vacuum cleaners. A canister-type vacuum cleaner includes a body mounted on wheels and a hose assembly for sucking dust or other foreign substances into the body. A suction generating device such as a suction fan, a motor for driving the suction generating device, and a disposable dust container for filtering dust or other foreign substances from air sucked by the vacuum cleaner, are positioned in the body.

An upright-type vacuum cleaner has a constitution which is similar to that of the canister-type vacuum cleaner. However, the upright-type vacuum cleaner differs in that it vacuums a surface directly beneath its body, so a hose assembly is not required.

These days, the canister-type vacuum cleaner is more frequently used than the upright-type vacuum cleaner.

FIG. 1 illustrates a canister-type vacuum cleaner 100. Vacuum cleaner 100 includes a floor cleaning unit 110, a canister unit 120 and a hose assembly 130 extended between floor cleaning unit 110 and canister unit 120.

Floor cleaning unit 110 includes a main brush (not shown) or a suction nozzle (not shown), and the like. Floor cleaning unit 110 is detachably connected to hose assembly 130. Hose assembly 130 comprises a rigid wand 132 and a flexible hose 134. Hose assembly 130 is pneumatically connected to a dust collecting compartment (not shown) of canister unit 120 through a suction hose connector 136.

Canister unit 120 mainly includes a hood 122, a cover 124 and a body 126. Hood 122 encloses the dust collecting compartment and is pivotally installed onto body 126 so that the dust collecting compartment can be opened and closed. Hood 122 is provided with an inlet opening 127 formed through hood 122 for receiving hose assembly 130. Hood 122 also is provided with a transparent window 128 for notifying the user of the dust collecting state. Cover 124 encloses a motor compartment (not shown) where an electric motor and a suction fan driven by the electric motor are positioned.

In the vacuum cleaner having the above-mentioned constitution, a strong sucking force is generated by the rotation of the motor installed at the driving compartment in the body during the use of the vacuum cleaner. The dust sucked into the floor cleaning unit (brush head) by the sucking force is collected in the dust envelope detachably installed in the dust collecting compartment and the filtered air is exhausted out through the driving compartment.

Recently, a power brush which is provided with a motor in a cleaning unit and rotates a brush roller, is developed and applied to the vacuum cleaner for increasing the sucking efficiency of the vacuum cleaner on the dust. In the power brush, when an electric source is applied and the power is on state, the driving motor continues its driving and the brush roller always rotates. Only when an electric switch is off, the electric source supplied to the driving motor is cut off and the driving of the motor is stopped.

FIG. 2 is a schematic perspective view for showing the power brush for the conventional vacuum cleaner. As illustrated in FIG. 2, the power brush is provided with a rotating roller 205 which rotates by the rotation of motor 240 and a moving roller 218 positioned at the front portion of the brush in a brush body 201. Rotating roller 205 rotates by motor 240 during the cleaning using the vacuum cleaner to increase the dust sucking efficiency of the vacuum cleaner. In the power brush, the cleaning efficiency can be increased through the rotation of rotating roller 205 during the cleaning. However, the rotation of rotating roller 205 when the user does not cleaning, is unnecessary. Moreover, this rotation becomes a factor of safety accidents. Accordingly, the rotation of rotating roller 205 should be stopped when the vacuum cleaner is not used.

Therefore, in the vacuum cleaner having the power brush, a safety device for the power brush of the vacuum cleaner, which stops the rotation of rotating roller 205 when the vacuum cleaner is not contemporarily used to prevent safety accidents, has been reported. FIG. 3 is a schematic perspective view for showing a safety device for the power brush of the conventional vacuum cleaner.

A safety device 250 illustrated in FIG. 3 includes a pressing member 212 which is provided at one front side of brush body 201. Pressing member 212 is rotatably supported at one front side of brush body 201, by rotating shafts **213*a* and 213*b* which are formed at both rear sides of pressing member 212. At the first front side of pressing member 212, a pair of front protrusive portions 212*b* protruded downward by constant angle with an angle of inclination, are provided. And at the upper portion of the second side facing the first side where front protrusive portions 212*b* are formed, a cam 212*a* is formed. At the front end portion of front protrusive portions 212*b*, joining holes 214 are formed. Into joining holes 214, a rotating shaft 219 of moving roller 218** is inserted.

An elastic piece 217 of a switch 220 is brought into contact with the upper surface of cam **212*a*. At the front upper portion of pressing member 212, a protrusive boss 215 is formed. At protrusive boss 215, a compressive spring 216 is inserted to provide an electric source to brush body 201 and to impart a rotating force to pressing member 212** to the direction A.

Moving roller 218 provided at front protrusive portion **212*b* of pressing member 212 facilitates the movement of brush body 201**.

When the user uses the vacuum cleaner, moving roller 218 contacts the bottom and pressing member 212 rotates to the reverse direction of the arrow A from the initial state. Accordingly, spring 216 is compressed and cam **212*a* rotates simultaneously to press elastic piece 217**. Then, the applying state of the electric current is kept and the electric current is supplied to the motor.

Next, when the user lifts brush body 201, moving roller 218 is separated from the bottom. At this time, pressing member 212 is pressed downward by spring 216 and rotates to the direction of arrow A. Then, cam **212*a* rotates and elastic piece 217 of switch 220 moves downward along the contacting surface of cam 212*a*** to transform into an off state.

Accordingly, the electric current supplied to the driving motor of the power brush is cut off.

In the safety device for the power brush of the conventional vacuum cleaner, the brush should be turned over when assembling the moving roller and the switch. Therefore, the assembling process is very difficult and complicated. And the manufacturing cost is increased.

SUMMARY OF THE INVENTION

It is an object of the present invention to provide a safety device for a brush of a vacuum cleaner, which has a simple structure and can automatically cut off an electric current applied to a driving motor of the power brush.

To accomplish the object of the present invention, there is provided a safety device for a power brush of a vacuum cleaner comprising a negative pressure acting portion which is attached to the power brush for the vacuum cleaner, and to which a negative pressure generated by a sucking force generated by a rotation of a driving motor in a body of the vacuum cleaner, acts, an air valve which moves according to a pressure change in the negative pressure acting portion, and a switch for cutting off an electric source applied to the driving motor of the power brush according to a movement of the air valve.

The negative pressure acting portion is a cylindrical air duct which is vertically provided on an upper portion of the power brush and further comprises a cap on an upper portion of the air duct, the cap having a plurality of air holes for an inflow of air into the air duct from an exterior.

An air valve moving portion moves the air valve within a predetermined angle range. The air valve moving portion comprises a rod having the air valve installed at a first end of the rod, a rotating shaft formed at a center portion of the rod for rotatably supporting the rod and a spring formed at a second end facing the first end for applying a rotating force to the air valve so that the air valve moves to an external direction.

A switch is provided at the second end side of the rod having said spring. The switch is off to cut off the electric source when the air valve moves to the external direction by an action of the spring, and the switch is on to supply the electric source to the motor by a pressure of the rod when the air valve moves inward by the negative pressure.

When an user lifts the brush body during the cleaning, the same atmospheric pressures act on the upper portion and the lower portion of the air duct. Accordingly, the rod moves around a moving piece by an elastic force of the spring. Then, the switch is off to cut off the electric current applied to the driving motor of the power brush to prevent the rotation of a rotating roller.

Therefore, when the vacuum cleaner having the power brush is not used, various safety accidents induced by the rotating force of the power brush can be prevented.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Hereinafter, the constituting elements and the operating principles according to a preferred embodiment of the present invention will be explained in more detail with reference to the accompanying drawings.

Figure 1:
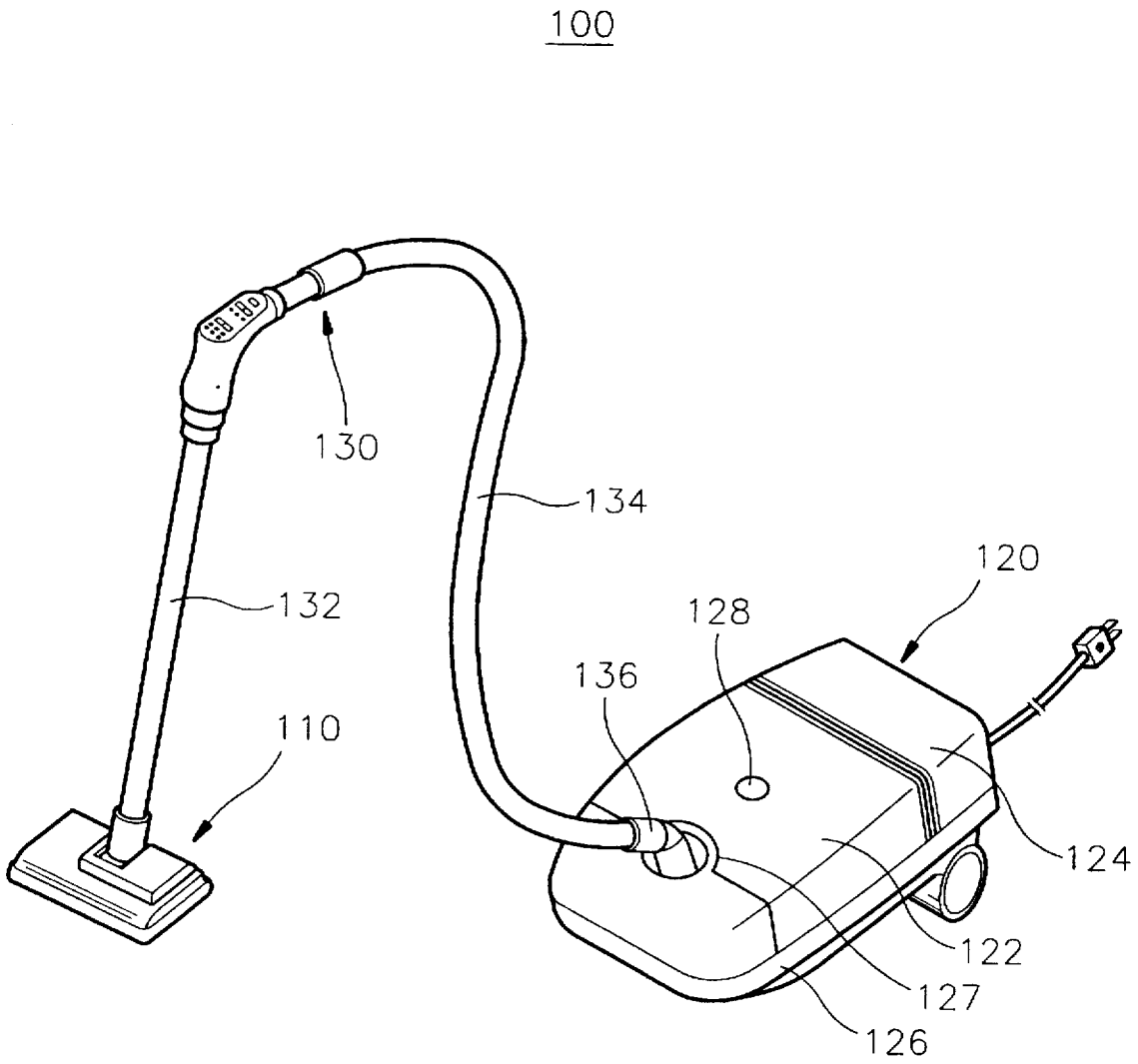
FIG. 1 (PRIOR ART)
FIG. 1 is a schematic perspective view illustrating the conventional canister-type vacuum cleaner.
Figure 2:
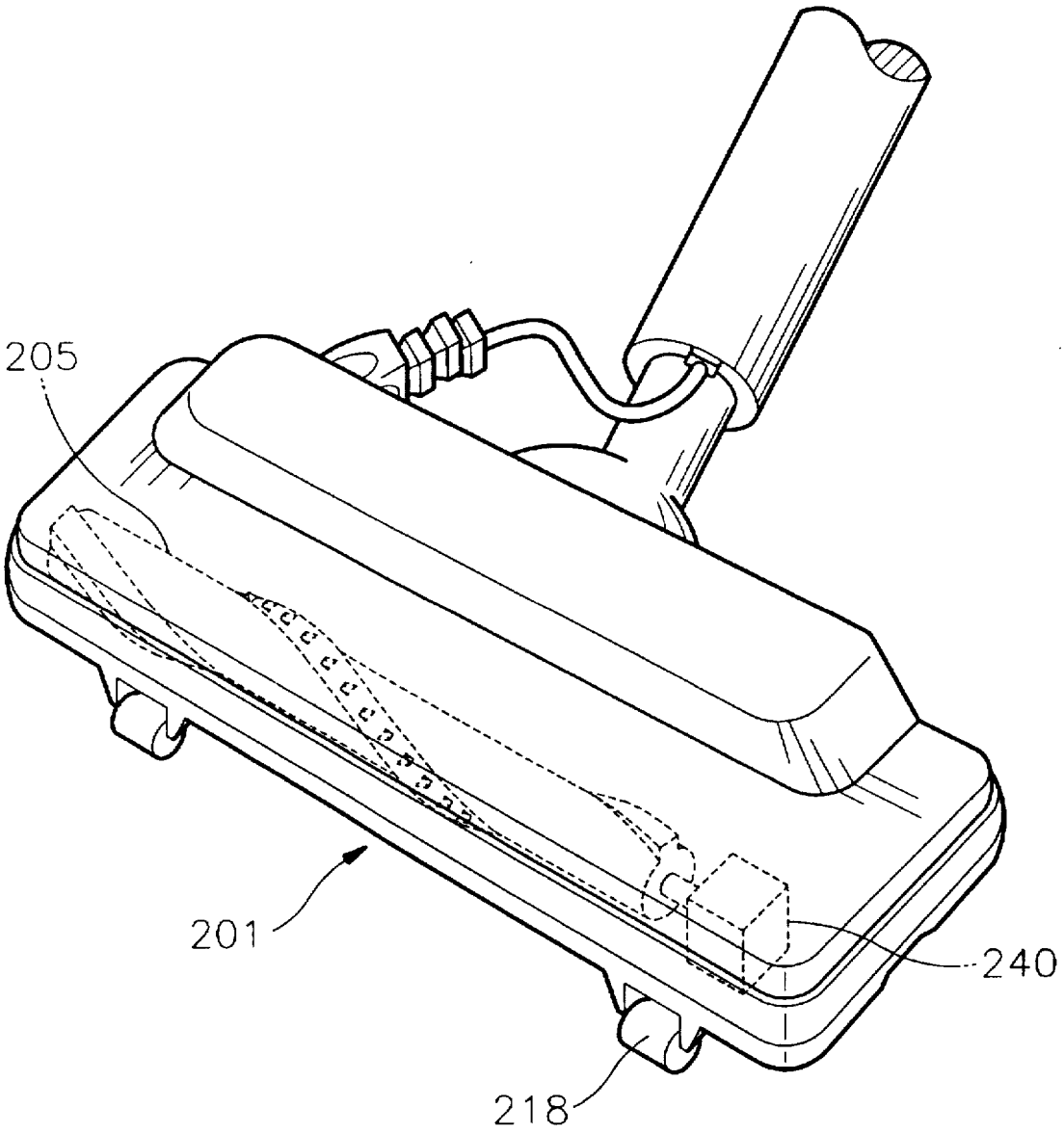
FIG. 2 (PRIOR ART)
FIG. 2 is a schematic perspective view for showing the power brush of the conventional vacuum cleaner.
Figure 3:
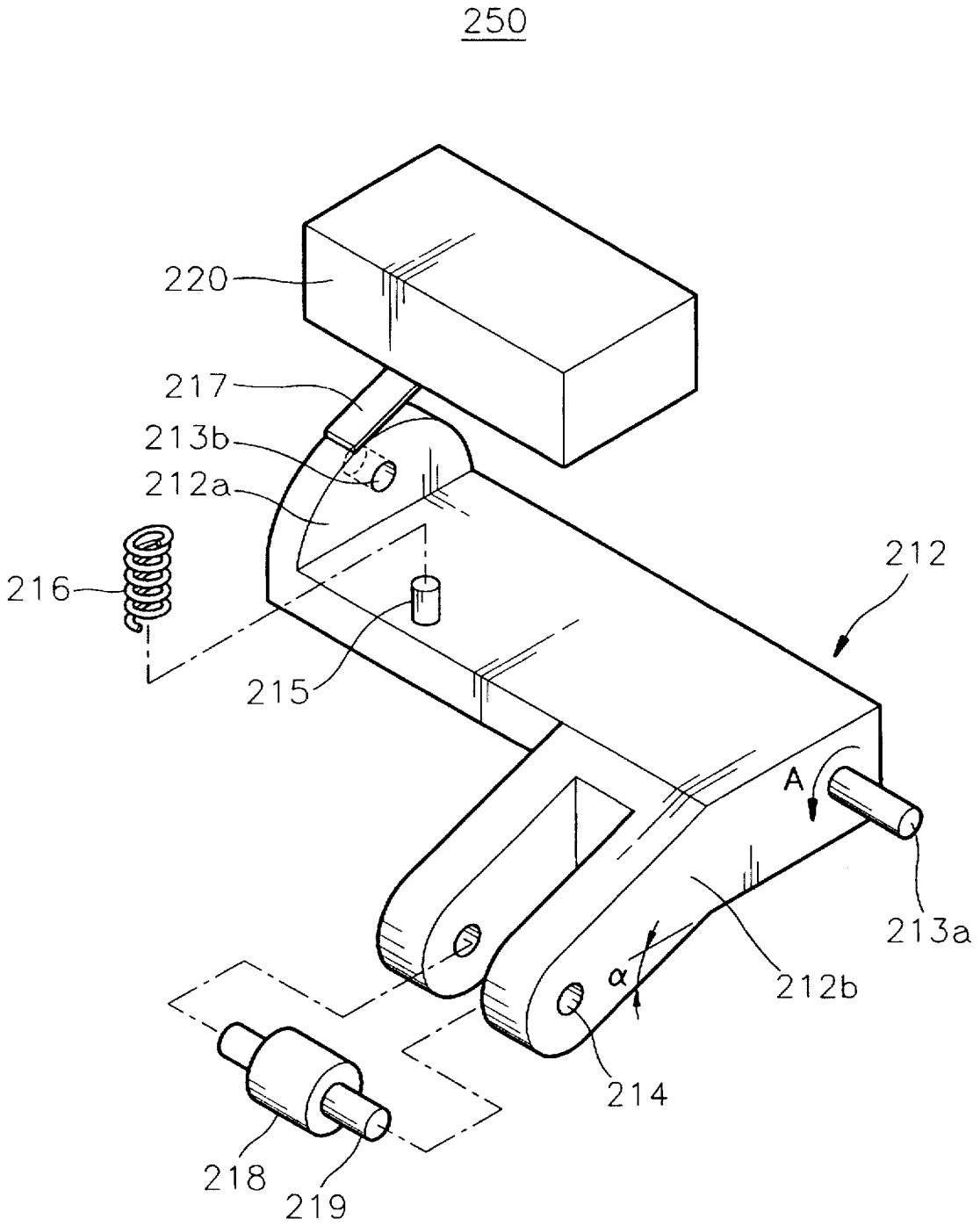
FIG. 3 (PRIOR ART)
FIG. 3 is a cross-sectional view for showing a safety device for the conventional power brush.
Figure 4:
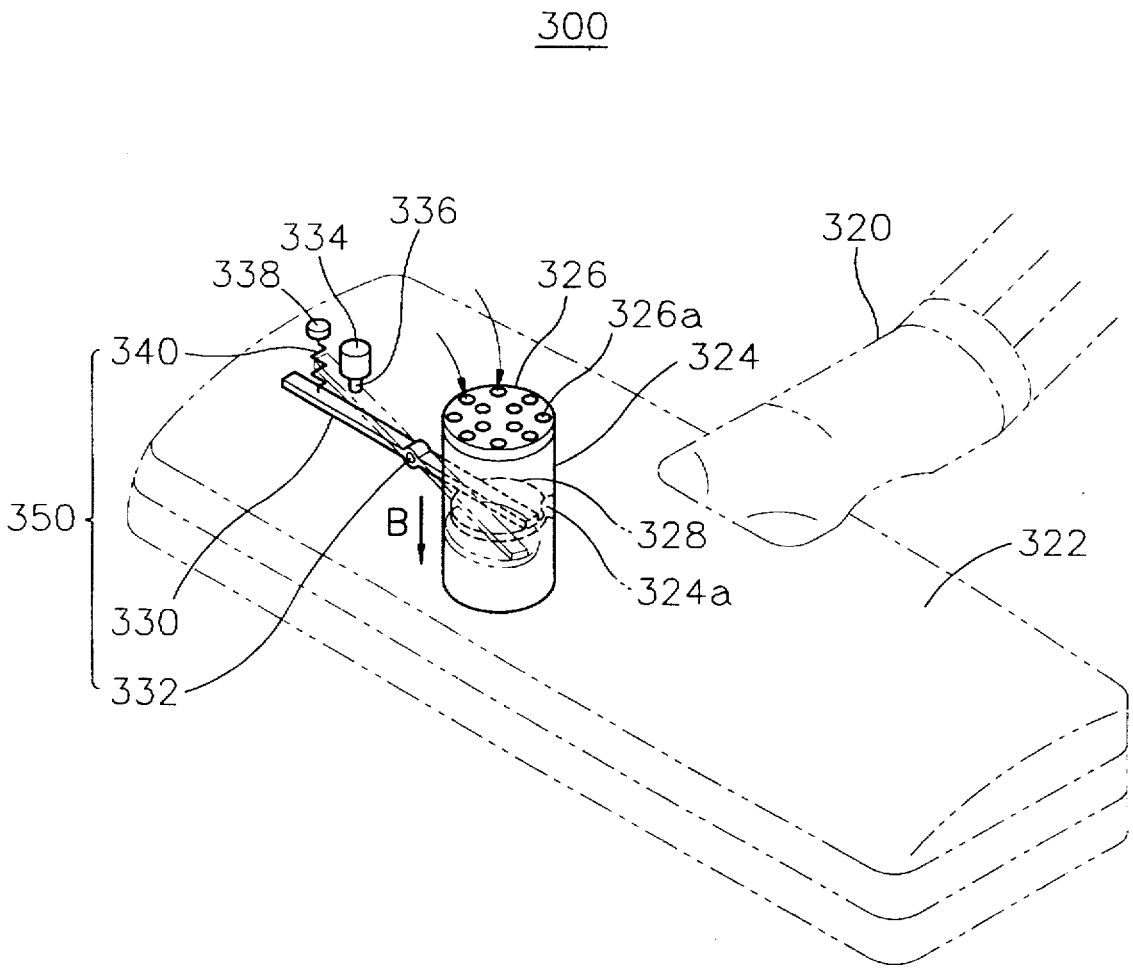
FIG. 4 is a perspective view for showing a safety device for the brush of a vacuum cleaner according to an embodiment of the present invention.
Figure 5:
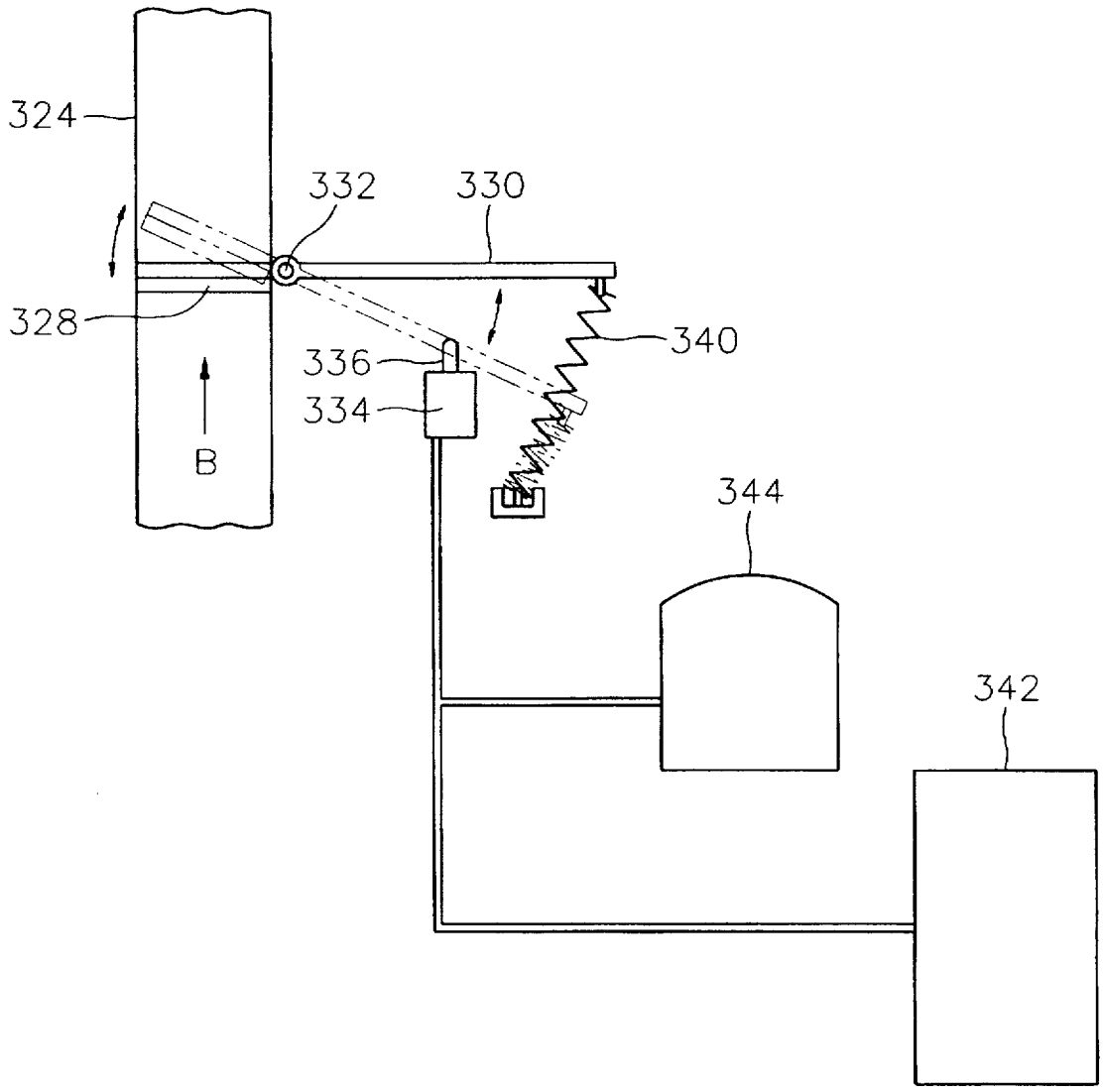
FIG. 5 is a schematic view for explaining the operating state of the safety device for the brush of the vacuum cleaner illustrated in FIG. 4.

FIG. 4 is a perspective view for showing a safety device for the brush of a vacuum cleaner according to an embodiment of the present invention and FIG. 5 is a schematic view for explaining the operating state of the safety device for the brush of the vacuum cleaner illustrated in FIG. 4.

As illustrated in the drawings, a brush body 322 is installed at an extended tube 320 of the rigid rod of the vacuum cleaner. A safety device for a brush of the vacuum cleaner 300 according to an embodiment of the present invention is attached to brush body 322 for the vacuum cleaner and is provided with an air duct 324 to which a negative pressure acts during the cleaning, which is generated by a sucking force generated by the rotation of a driving motor (not shown) in a body of the vacuum cleaner (not shown). As shown in FIG. 4, air duct 324 has a cylindrical shape and is vertically provided on the upper portion of brush body 322. On the upper portion of air duct 324, a cap 326 having a plurality of air holes **326*a*** for the inflow of air into the air duct from the exterior, is installed.

In air duct 324, an air valve 328 is provided. Air valve 328 is provided so that it can move according to the change of the pressure in air duct 324.

An air valve moving portion 350 moves air valve 328 within a predetermined angle range. Air valve moving portion 350 includes a rod 330 to which air valve 328 is installed at the first end of rod 330, a rotating shaft 332 formed at the center portion of rod 330 for rotatably supporting rod 330 and a spring 340 formed at the second end facing the first end for applying a rotating force to rotate air valve 328 to an external direction (which is the reverse direction of arrow B).

A movement preventing protrusive portion **324*a* can be formed in air duct 324 for preventing the movement of air valve 328 to the external direction, as occasion needs. Movement preventing protrusive portion 324*a*** can be formed in a circular shape, an arc shape, etc.

A switch 334 cuts off an electric source 342 applied to a driving motor 344 of the rotating roller (not shown) of the power brush according to the movement of air valve 328. Switch 334 is provided at the second end side of rod 330 to which spring 340 is provided. When air valve 328 moves to the external direction by the action of spring 340, switch 334 is off and cuts off electric source 342 applied to driving motor 344 of the rotating roller. During cleaning, air valve 328 moves into the brush and to the direction of arrow B according to the inflow of the external air by a negative pressure generated by the motor of the body when brush body 322 contacts the bottom. At this time, rod 330 presses a protrusive portion 336 of switch 334 and switch 334 is on. Then, the electric current from electric source 342 is applied to power brush motor 344.

Hereinbelow, the operation of the safety device for the power brush of the vacuum cleaner having the above-mentioned constitution will be described.

When the vacuum cleaner does not operate, an atmospheric pressure is applied to air valve 328 through upper cap 326 installed on air duct 324. The switch of the vacuum cleaner is on and the brush body contacts with a floor to start the cleaning. When the motor in the body of the vacuum cleaner starts rotating, a negative pressure is applied to the lower portion of air duct 324. Accordingly, the external air flowing into air duct 324 through air holes 326*a* of upper cap 326 descends to the direction of arrow B. Accordingly, air valve 328 moves from the position indicated by a solid line to the position indicated by a dotted line, as shown in FIG. 4.

As the result, rod 330 rotates around rotating shaft 332 and the second end facing the first end where air valve 328 is formed, ascends. Then, the ascending rod 330 presses spring 340 and protrusive portion 336 of switch 334 upward to turn switch 334 on. By keeping the on state, the electric current from electric source 342 can be continuously applied to driving motor 344 of the power brush to rotate driving motor 344.

With reference to FIG. 5, when the user lifts the brush body during the cleaning, the same atmospheric pressures are applied to the upper portion and the lower portion of air duct 324. Accordingly, rod 330 moves by the elastic force of spring 340 around moving piece 332 from the position indicated by a solid line to the position indicated by a dotted line. Then, protrusive portion 336 of switch 334 protrudes downward (to the direction of arrow B) and cuts off the electric current applied to driving motor 344 to prevent the rotation of the rotating roller.

Therefore, various safety accidents induced by the rotating force of the power brush when the vacuum cleaner having the power brush is not used, can be prevented.

According to the present invention, the electric current applied to the driving motor of the power brush is cut off by the mutual action of the atmospheric pressure acting on the exterior with the negative pressure generated by the motor in the body. Accordingly, the structure of the device is simple and the manufacture thereof is advantageous. Moreover, the manufacturing cost can be reduced.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A safety device for a power brush of a vacuum cleaner comprising:

a negative pressure acting portion which is attached to said power brush for said vacuum cleaner, and to which a negative pressure generated by a sucking force generated by a rotation of a driving motor in a body of said vacuum cleaner, acts;

an air valve which moves according to a pressure change in said negative pressure acting portion; and a switch for cutting off an electric source applied to said driving motor of said power brush according to a movement of said air valve.

2. A safety device for a power brush of a vacuum cleaner as claimed in claim 1, wherein said negative pressure acting portion is a cylindrical air duct which is vertically provided on an upper portion of said power brush.

3. A safety device for a power brush of a vacuum cleaner as claimed in claim 2, wherein said negative pressure acting portion further comprises a cap on an upper portion of said air duct, said cap having a plurality of air holes for an inflow of air into said air duct from an exterior.

4. A safety device for a power brush of a vacuum cleaner as claimed in claim 1, wherein said air valve further comprises an air valve moving portion for moving said air valve within a predetermined angle range.

5. A safety device for a power brush of a vacuum cleaner as claimed in claim 4, wherein said air valve moving portion comprises:

a rod having said air valve installed at a first end of said rod;

a rotating shaft formed at a center portion of said rod for rotatably supporting said rod; and a spring formed at a second end facing said first end for applying a rotating force to said air valve so that said air valve moves to an external direction.

6. A safety device for a power brush of a vacuum cleaner as claimed in claim 5, wherein a movement preventing protrusive portion is provided in said negative pressure acting portion for preventing a movement of said air valve to said external direction.

7. A safety device for a power brush of a vacuum cleaner as claimed in claim 5, wherein said switch is provided at said second end side of said rod having said spring, said switch is off to cut off said electric source when said air valve moves to said external direction by an action of said spring, and said switch is on to supply said electric source to said motor by a pressure of said rod when said air valve moves inward by said negative pressure.

8. A safety device for a power brush of a vacuum cleaner comprising:

a cylindrical air duct which is attached to said power brush of said vacuum cleaner and vertically provided on an upper portion of said power brush, a negative pressure generated by a sucking force generated by a rotation of a driving motor in a body of said vacuum cleaner acting on said air duct;

an air valve moving inward by said negative pressure in said air duct;

a rod having said air valve installed at a first end of said rod, and a spring formed at a second end facing said first end for applying a rotating force for moving said air valve to an external direction, said rod being movably supported by a moving shaft provided near an external periphery of said air duct; and a switch provided at said second end of said rod having said spring, said switch being off to cut off an electric source when said air valve moves to an external direction by an action of said spring, said switch being on to supply said electric source to said motor when said air valve moves inward by said negative pressure.

9. A safety device for a power brush of a vacuum cleaner as claimed in claim 8, further comprising a cap on an upper portion of said air duct, said cap having a plurality of air holes for an inflow of air into said air duct from an exterior.

10. A safety device for a power brush of a vacuum cleaner as claimed in claim 8, further comprising a movement limiting protrusive portion provided in said air duct, for limiting a movement of said air valve to said external direction.

* * * * *